US007900863B1

(12) United States Patent
Cheng

(10) Patent No.: US 7,900,863 B1
(45) Date of Patent: Mar. 8, 2011

(54) RETRACTABLE CABLE DEVICE HAVING PROTECTING FUNCTION

(76) Inventor: Chi-Wen Cheng, Guangdong (CN)

( * ) Notice: Subject to any disclaimer, the term of this patent is extended or adjusted under 35 U.S.C. 154(b) by 50 days.

(21) Appl. No.: 12/562,129

(22) Filed: Sep. 17, 2009

(51) Int. Cl.
*B65H 75/48* (2006.01)

(52) U.S. Cl. ..... 242/378.1; 242/378.2; 242/378.3

(58) Field of Classification Search ..... 242/278, 242/278.1–278.3, 379; 191/12.2 R
See application file for complete search history.

(56) References Cited

U.S. PATENT DOCUMENTS 5,098,028 A * 3/1992 Ida et al. ..... 242/388.6
5,332,171 A * 7/1994 Steff ..... 242/378
6,199,784 B1 * 3/2001 Wang et al. ..... 242/378
6,328,243 B1 * 12/2001 Yamamoto ..... 242/378.1
6,726,140 B2 * 4/2004 Wivagg ..... 242/378.2
7,017,846 B2 * 3/2006 Tsoi et al. ..... 242/378.2
2004/0200919 A1 * 10/2004 Burke et al. ..... 242/378.1
2005/0184186 A1 * 8/2005 Tsoi et al. ..... 242/378.1

* cited by examiner

*Primary Examiner* — Sang Kim
(74) *Attorney, Agent, or Firm* — Banger Shia

(57) ABSTRACT

A retractable cable device having protecting function mainly comprises a housing, a spiral spring, a spool disk, an arresting system, and a communication cable. The spool disk pivoted on a shaft within the housing is wound by the communication cable. The spiral spring provides the spool disk with a reeling force to reel in the communication cable. The rotation of the spool disk flexibly controlled by the arresting system decides the protruding length of the communication cable. A swaying member installed on the spool disk is utilized to replace the conventional immovable clip for fixing the communication cable. Whereby, when the entire communication cable is drawn out, the communication cable at a second end of the swaying member presents a larger bent angle. Therefore, the communication cable is subjected to bending with less sharp degree, thence protecting the communication cable, especially for the core, by preventing it from damage.

7 Claims, 10 Drawing Sheets

40

RETRACTABLE CABLE DEVICE HAVING PROTECTING FUNCTION

BACKGROUND OF THE INVENTION

1. Field of the Invention

The present invention relates to a receiving device of the communication cable, in particular to a retractable cable device having protecting function.

2. Description of the Related Art

With the advancement of the society and the novel technology of each passing day, electronic communication apparatus are extensively developed to provide people with convenient lives. The apparatus like PDA, cell phones, MP3, MP4, personal computers, and other computer peripheral equipment are all equipped with proper cables that contain USB or HDMI provided at the two ends thereof, so that the information could be communicated. However, the communication cable is often long, and the redundant cable is usually left on the floor or piled on the desk corner, hence incurring an untidy and disorderly arrangement that even occupies spaces. Moreover, the redundant cable is also prone to get entangled or damaged by the rude pulling and dragging force, which affects the communication efficiency and results in an impractical usage.

Several retractable cable devices have been already marketed for preferably achieving the object of effectively using and receiving the communication cable. The marketed retractable cable device substantially includes a housing, and a spool disk, a spiral spring, and an arresting system that are all installed within the housing. Wherein, the communication cable is received in the housing and wound around the spool disk. The spiral spring provides the spool disk with a reeling force, and the arresting system controls the reeling-in and reeling-out of the retractable cable device. Therefore, in using the communication cable, it can be pulled out and arrested until a needed length is reached; oppositely, when users do not need the communication cable, it can be completely received within the housing to accomplish the convenient storage and carrying efficiency.

Although providing users with the storage efficiency, the marketed retractable cable device still lacks the preferred applicable competence since it is deficient in its structural design and properties. Especially, the design of the marketed retractable cable device merely emphasizes the convenience of the reeling-in and reeling-out of the communication cable but neglects the protective design of the communication cable. Referring to FIG. 1, the fastening structure of the communication cable in the marketed retractable cable is usually achieved by a spool disk 30' having an immovable clip 60' installed thereon. Thereby, an inner winding of the communication cable would be clipped between the immovable clip 60' and an outer wall of the spool disk 30', and while the communication cable 50 stretches out of the immovable clip 60', one end of which 501' would be reversely bent as illustrated. However, in the practical application, the communication cable 50 is often entirely pulled out. Thus, after a long-term pulling and dragging of the product, the core of the communication cable is subjected to fracture, hence incurring an inferior communicative quality of the product.

SUMMARY OF THE INVENTION

Therefore, the object of the present invention is to provide a retractable cable device having protecting function that prevents the core of the communication cable from breakage via improving the fastening structure of the communication cable's inner winding so as to avoid an inferior quality of the product.

The present invention in conformity with the present invention applies the following techniques:

The present invention mainly comprises a housing, a spiral spring, a spool disk, an arresting system, and a communication cable. Wherein, the spool disk is pivoted on a shaft inside the housing, and the communication cable is wound around the spool disk. Moreover, one end of the spiral spring is coupled to the spool disk, and other end thereof is coupled to the shaft, so the spool disk is provided with a reeling force to retract the communication cable. A rotation of the spool disk is flexibly controlled by the arresting system to decide a protruding length of the communication cable. The spool disk further includes a swaying member installed thereon, and the housing further has a limiting ring installed thereon to limit the outward swaying scope of the swaying member. Wherein, a first end of the swaying member is vertically and pivotally coupled to the spool disk, thereby forming a fixed interval between the first end and an outer wall of the spool disk. Additionally, a second end of the swaying member is directed to a movable portion. Thereby, the communication cable passes through the fixed interval to be reversely bent at the second end so as to wind on the swaying member.

Preferably, the swaying member includes an inner portion and an outer portion integrally formed thereon, and the inner portion and the outer portion are connected at the second end by a smooth arc.

Preferably, the arresting system includes a movable engaging member and a plurality of limiting notches defined on the spool disk. Wherein, the limiting notches are defined on an upper end of the spool disk as well as evenly and compactly spread around the shaft, and each of which has its respective inward and upward cavity. Additionally, a locating ring is further disposed on a center of the upper end of the spool disk. Moreover, the movable engaging member includes an operating portion, an annular portion, an engaging portion, and a relocating portion integrally formed thereon. Wherein, the shaft is surrounded by the annular portion so as to define a lateral interval therebetween. The operating portion and the engaging portion are respectively and integrally connected to two opposite sides of the annular portion. The operating portion is upwardly protruded out of the housing, a middle portion of the operating portion is inserted in a transverse notch of the housing, a hook is downwardly extended from an extended tail of the engaging portion, and the hook is downwardly stretched into the limiting notch. The relocating portion is integrally, slantingly, and downwardly extended from a lower surface of the engaging portion, and the extended tail is elastically propped against an external portion of the locating ring.

Preferably, the upper end and a lower end of the outer wall of the spool disk respectively and integrally provide with an ear for the first end of the swaying member to be pivoted therebetween.

Preferably, the second end of the swaying member further installs a limiting structure to limit the moving scope of the communication cable.

Preferably, the limiting structure adopts a curve penetrating slot that is integrally formed on the swaying member for the communication cable to pass through.

Preferably, the limiting structure adopts a soft limiting member mounted on the second end of the swaying member, and the soft limiting member further provides with a curve penetrating slot for the communication cable to pass through.

Accordingly, the present invention performs preferable advantages and benefits. The present invention replaces the conventional immovable clip via the swaying member that is outwardly movable installed on the spool disk. By means of the swing of the swaying member, the bent angle of the communication cable at the second end can be increased, and the communication cable is subjected to a less sharp degree of bending. Therefore, the communication cable preferably avoids the damage and favorably becomes protected, especially for the core. Moreover, the arrest of the spool disk is accomplished via the cooperation of the movable engaging member and the circularly and densely spread limiting notches. Thus, the structure of the product could be more compact, and the brake performance of the spool disk could be greatly improved, which results in a more precise positioning control of the communication cable's stretching length and conduces to the using convenience.

The advantages of the present invention over the known prior arts will become more apparent to those of ordinary skilled in the art by reading the following descriptions with the relating drawings.

DETAILED DESCRIPTION OF THE PREFERRED EMBODIMENTS

Figure 1:
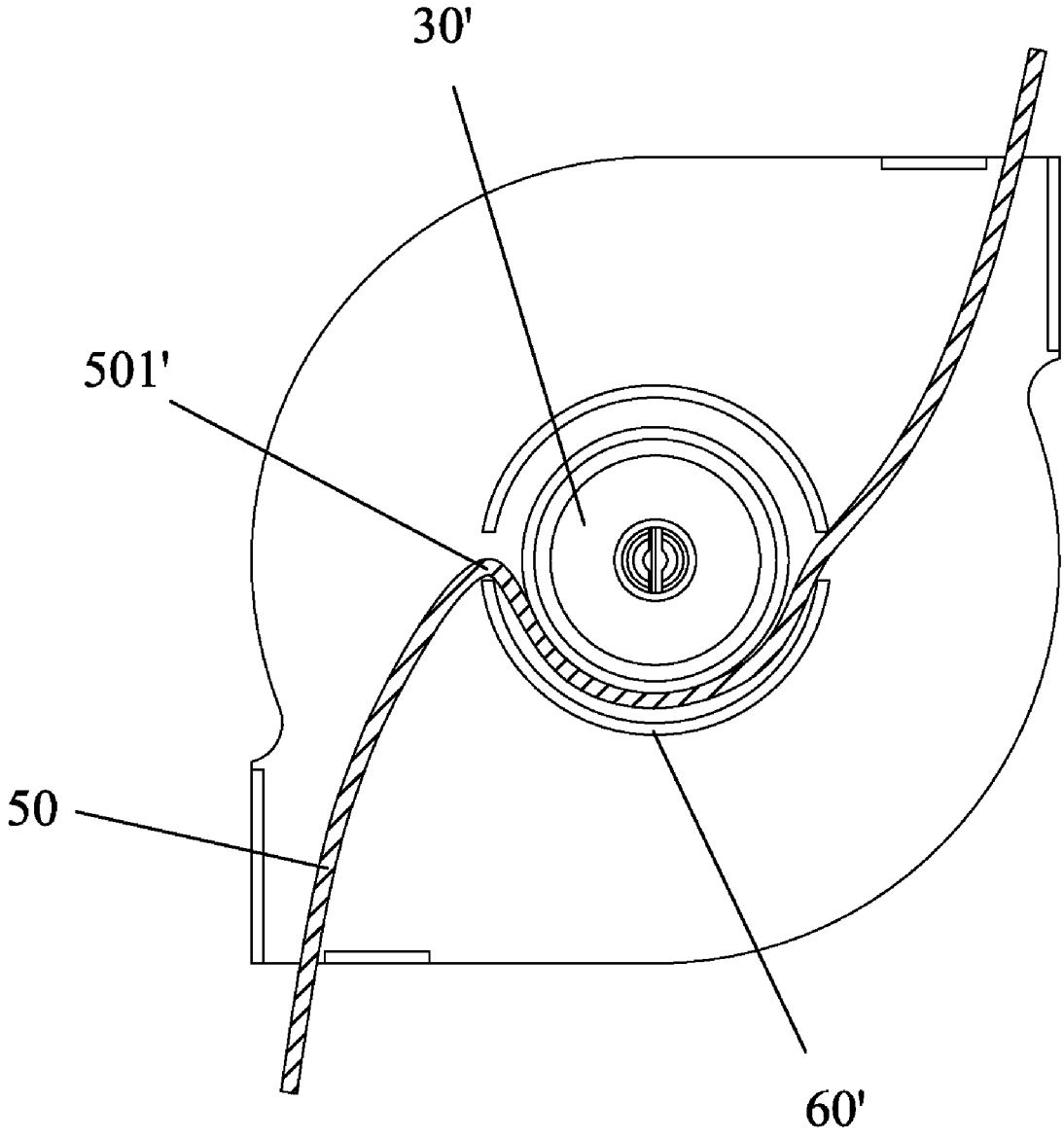
FIG. 1 Prior Art
FIG. 1 is a schematic view showing a conventional invention.
Figure 2:
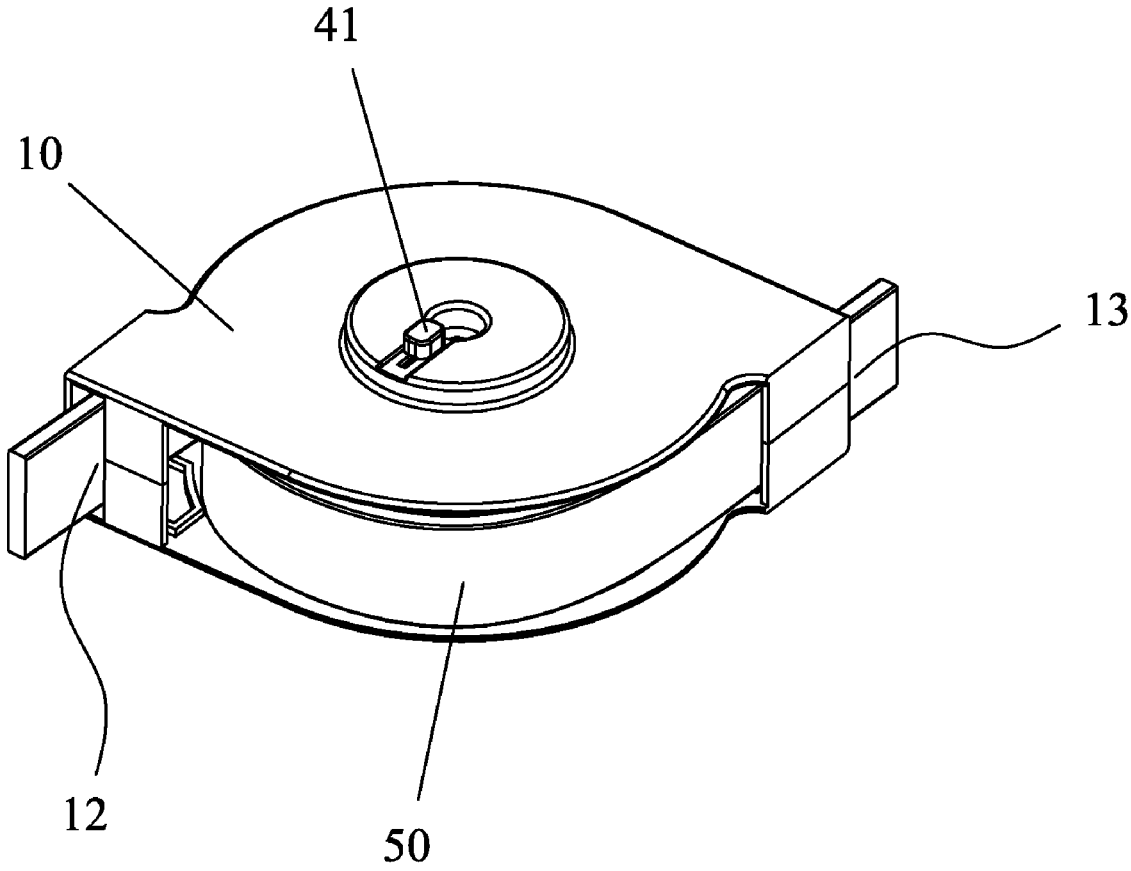
FIG. 2 is a perspective view showing the present invention.
Figure 3:
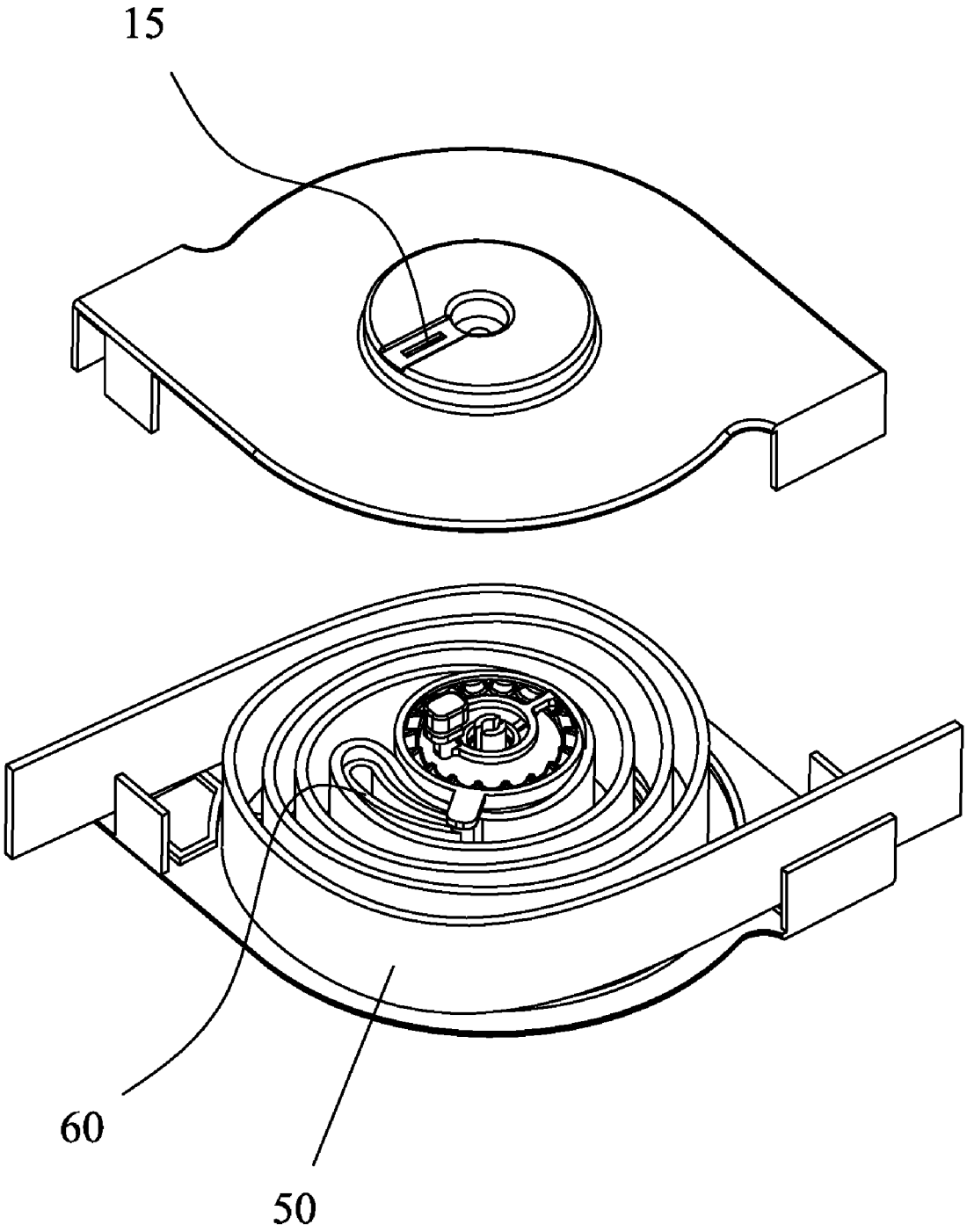
FIG. 3 is a partial exploded view showing the present invention.

Referring to FIGS. 2 to 11, the present invention mainly comprising a housing 10, a spiral spring 20, a spool disk 30, an arresting system, and a communication cable 50.

Wherein, the housing 10 includes an accommodation, at the center of which an upright shaft 11 is installed, and two output exits 12, 13 are respectively disposed at two opposite sides of the accommodation.

Figure 4:
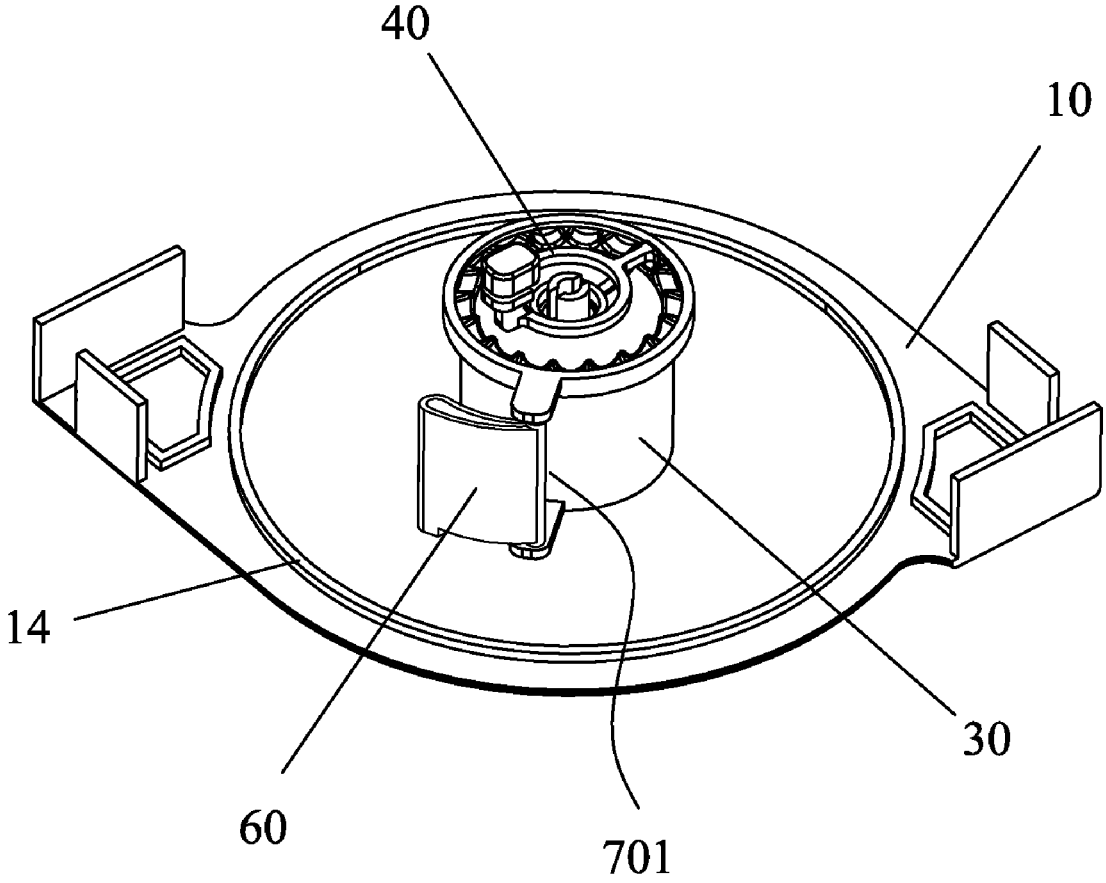
FIG. 4 is a partial view showing the present invention.
Figure 5:
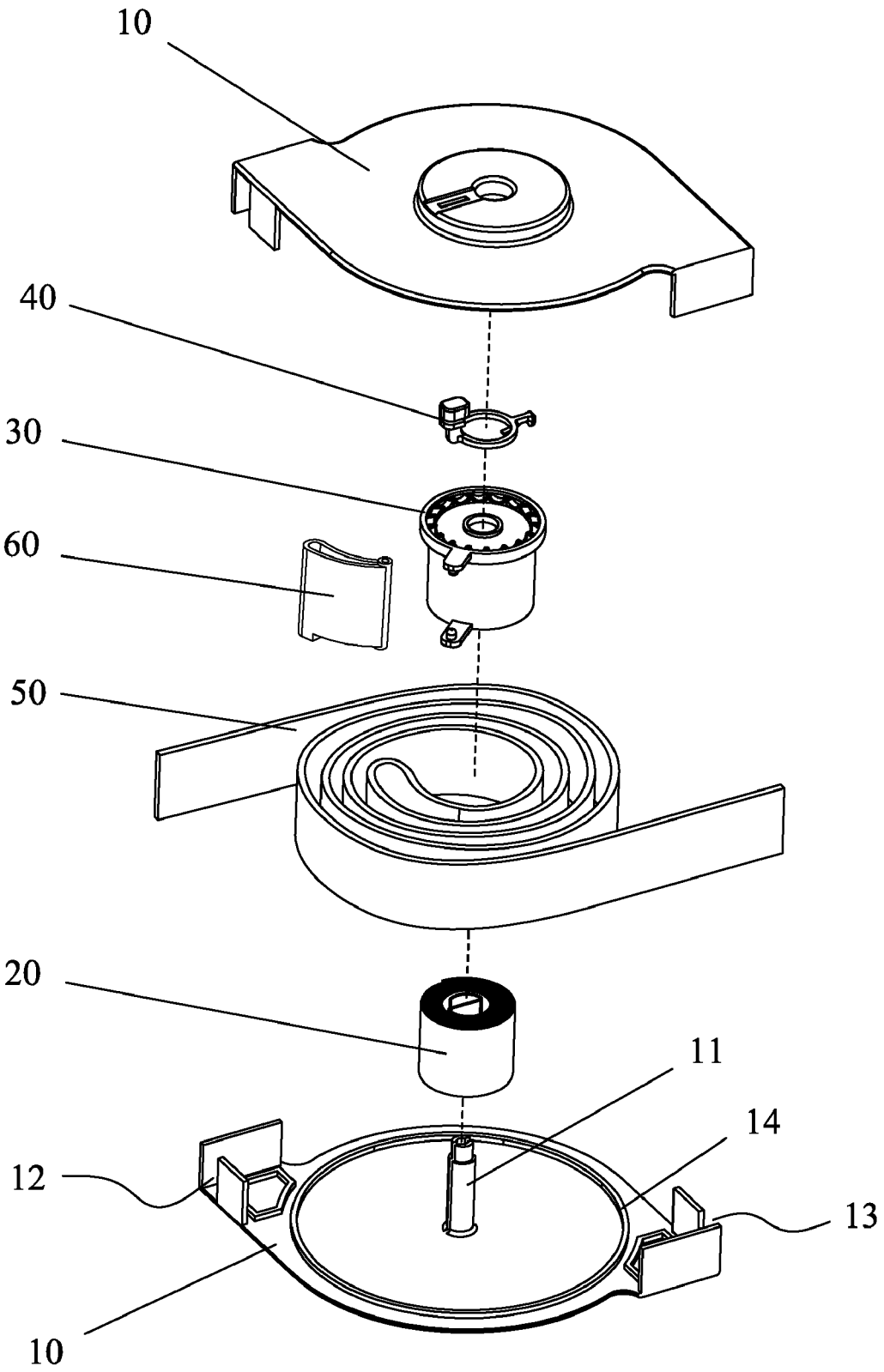
FIG. 5 is an exploded view showing the present invention.
Figure 7:
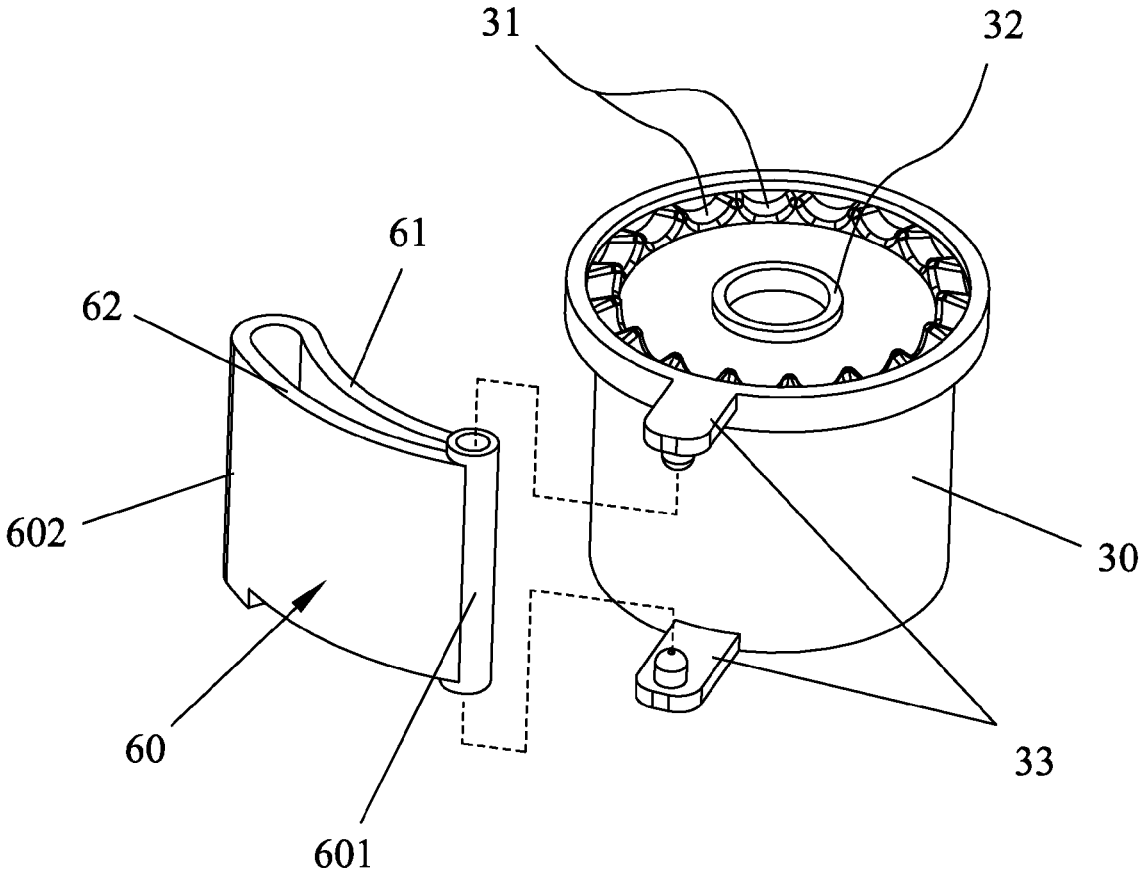
FIG. 7 is an exploded and enlarged view showing the spool disk and the swaying member of the present invention.

The spool disk 30 is mounted in the accommodation and is pivoted on the shaft 11 inside the housing 10. Especially, the spool disk 30 further includes a swaying member 60 installed thereon. As shown in FIGS. 4 and 7, a first end 601 of the swaying member 60 is vertically and pivotally coupled to ears 33 that are laterally extended from the outer wall of the spool disk 30, thereby forming a fixed interval 701 between the first end 601 and the outer wall of the spool disk 30. Additionally, a second end 602 of the swaying member 60 is directed to a movable portion and is curvedly extended to surround the spool disk 30. Preferably, the swaying member 30 includes an inner portion 61 and an outer portion 62 integrally formed thereon, and the inner portion 61 and the outer portion 62 are connected at the second end 602 by a smooth arc.

An inner winding of the communication cable 50 passes through the fixed interval 701 for being densely clamped and gets a reverse bent at the second end 602 for winding round the swaying member 60. Thus, the communication cable 50 could surround the spool disk 30.

The housing 10 further has a limiting ring 14 installed thereon to limit the outward swaying scope of the swaying member 60.

One end of the spiral spring 20 is coupled to the spool disk 30, and other end thereof is coupled to the shaft 11, so the spool disk 30 is provided with a reeling force to retract the communication cable 50.

A rotation of the spool disk 30 is flexibly controlled by the arresting system to decide a protruding length of the communication cable 50. Substantially, the arresting system includes a movable engaging member 40 and a plurality of limiting notches 31 defined on the spool disk 30.

Wherein, as shown in FIG. 7, the limiting notches 31 are defined on an upper end of the spool disk 30 as well as evenly and compactly spread around the shaft 11, and each of the limiting notches 31 has its respective inward and upward cavity. Additionally, a locating ring 32 is further disposed on a center of the upper end of the spool disk 30.

Figure 6:
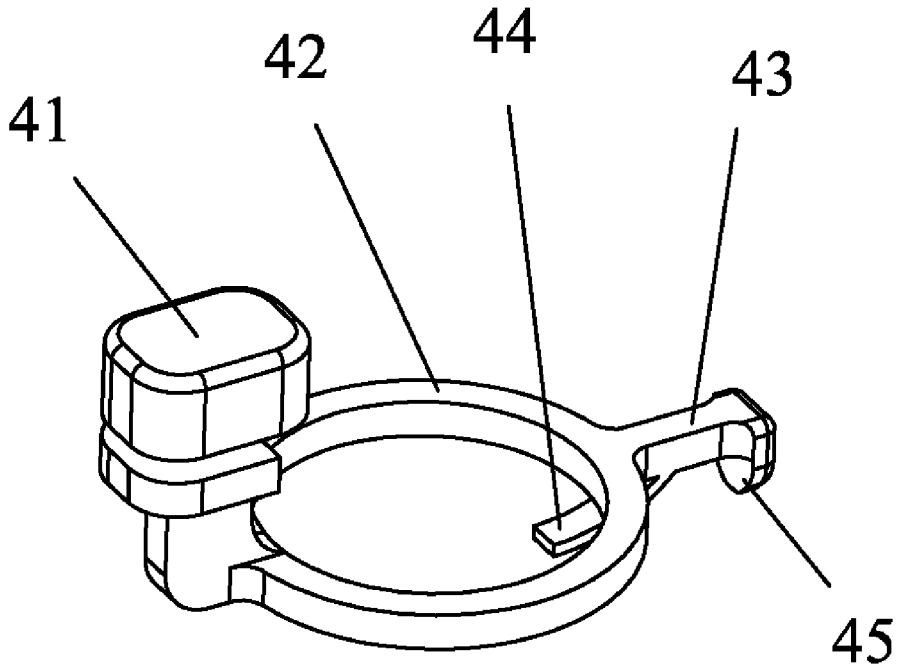
FIG. 6 is an enlarged view showing the movable engaging member of the present invention.

Referring to FIGS. 6 and 4, the movable engaging member 40 includes an operating portion 41, an annular portion 42, an engaging portion 43, and a relocating portion 44 integrally formed thereon. Wherein, the shaft 11 is surrounded by the annular portion 42 so as to define a lateral interval therebetween. The operating portion 41 and the engaging portion 43 are respectively and integrally connected to two opposite sides of the annular portion 42. The operating portion 41 is upwardly protruded out of the housing 10, a middle portion of the operating portion 41 is inserted in a transverse notch 15 of the housing 10, a hook 45 is downwardly extended from an extended tail of the engaging portion 43, and the hook 45 is downwardly stretched into the limiting notches 31. The relocating portion 44 is integrally, slantingly, and downwardly extended from a lower surface of the engaging portion 43, and the extended tail is elastically propped on an external portion of the locating ring 32.

Before operation, the communication cable 50 is entirely received in the accommodation of the housing 10. Moreover, the hook 45 of the movable engaging member 40 is inserted in the notches 31 to limit the rotation of the spool disk 30. Especially, in view of the specific calculation and design of the inclined angle of the notches 31's side walls and the engaging portion 43's elastic deformation force, the hook 45 provides the spool disk 30 with an ideal limiting force via the limiting notches 31. Wherein, the limiting force should be slightly larger than the maximum reeling force provided by the spiral 20, so that the rotation of the spool disk 30 can be limited. As it should be, the limiting force should not be so large that users need not impart great effort to pull out the communication cable 50.

When a certain length of the communication cable 50 is needed, users need to concurrently pull out the plug connectors (not shown) at the two ends of the communication cable 50. If the pulling force is larger than the limiting force bestowed on the spool disk 30 by the hook 45 through the limiting notches 31, the reeled communication cable 50 can be outwardly pulled to correspondingly bring the reverse rotation of the spool disk 30. Herein, the hook 45 is throbbed between the notches 31.

When users draw the communication cable with the desired length, the dragging force would be naturally released. Herein, since the outward dragging force is decreased or vanished, the hook 45 could be inserted into the limiting notches 31 again to limit the re-rotation of the spool disk 30, so that the spool disk 30 would impede the reeling of the communication cable 50, and the communication cable 50 could be fixed with a proper length.

Figure 8:
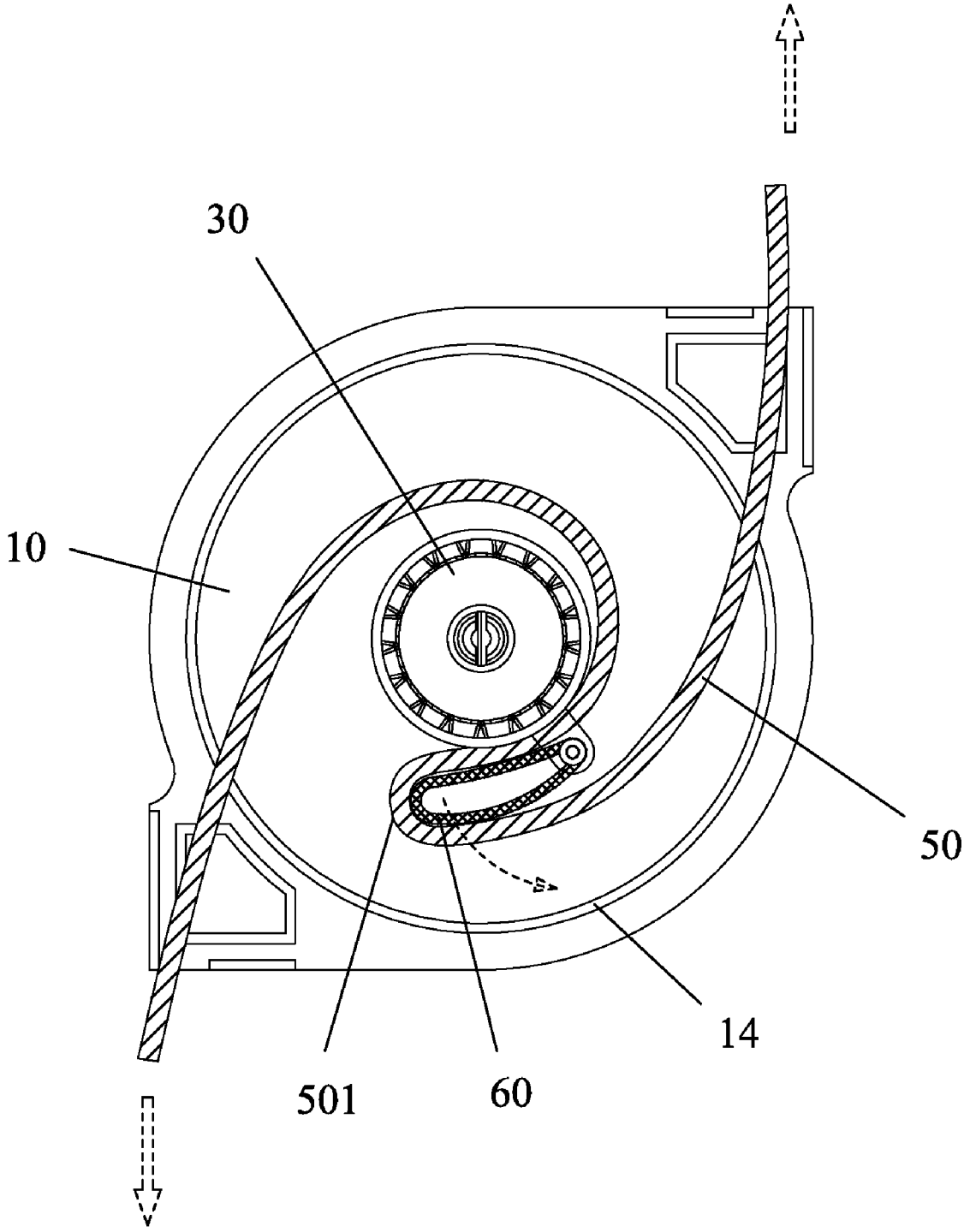
FIG. 8 is a schematic view showing the present invention in time of operating, and the communication cable will be entirely pulled out as arrowed.
Figure 9:
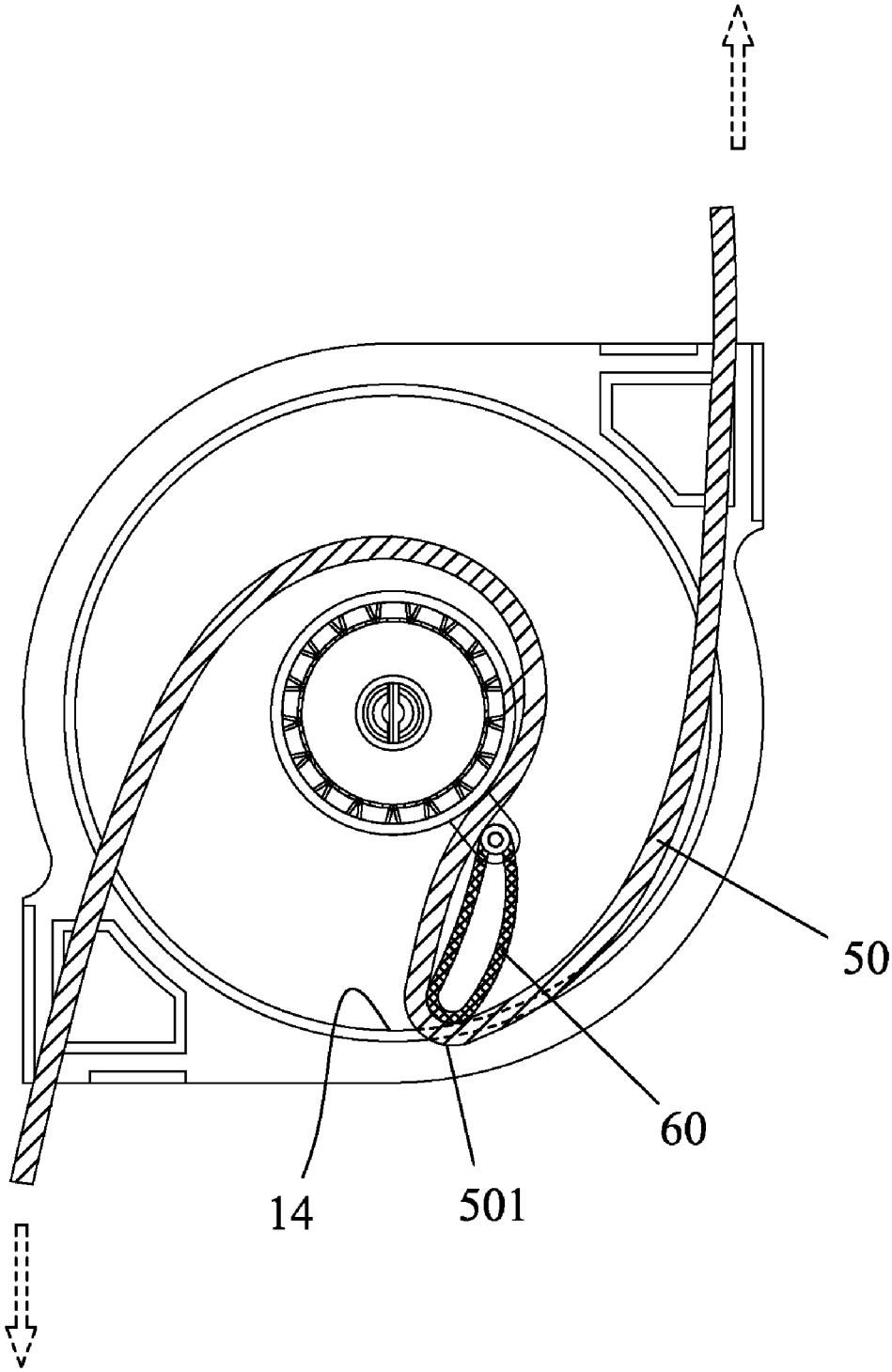
FIG. 9 is another schematic view showing the present invention in time of operating, and the communication cable is entirely pulled out.

When the communication cable 50 is entirely drawn out as shown in FIGS. 8 and 9, the swaying member 60 outwardly swings in accordance with the moving direction of the communication cable 50 until it props against the internal portion of the limiting ring 14.

After using, if the partial or entire communication cable 50 needs to be reeled in, users needs to outwardly pull the operating portion 41 of the movable engaging member 40, so that the entire movable engaging member 40 would laterally slide in one direction. Thereby, the hook 45 of the movable engaging member 40 would also be laterally slipped out of the limiting notch 31, which counteracts the limiting force imparted toward the spool disk 30. Herein, since the spool disk 30 is merely rotated by the single reeling force provided by the spiral spring 20, the spool disk 30 could be speedily and reversely rotated to reel in the communication cable 50. As to the swaying member 60, it would inwardly swing in conformity with the movement of the communication cable 50 to resume its position. If the communication cable 50 is taken up to a certain length, the pulling force to the operating portion 41 is released. By means of the elastic relocation of the relocating portion 44 functioning on the movable engaging member 40, the movable engaging member 40 could be inserted into the limiting notch 31 again to limit the rotation of the spool disk 30, and the communication cable 50 would be suspended at the corresponsive protruding length. As it should be, if users keep outwardly pulling the operating portion 41, the entire communication cable 50 could be reeled in the housing 10.

Figure 10:
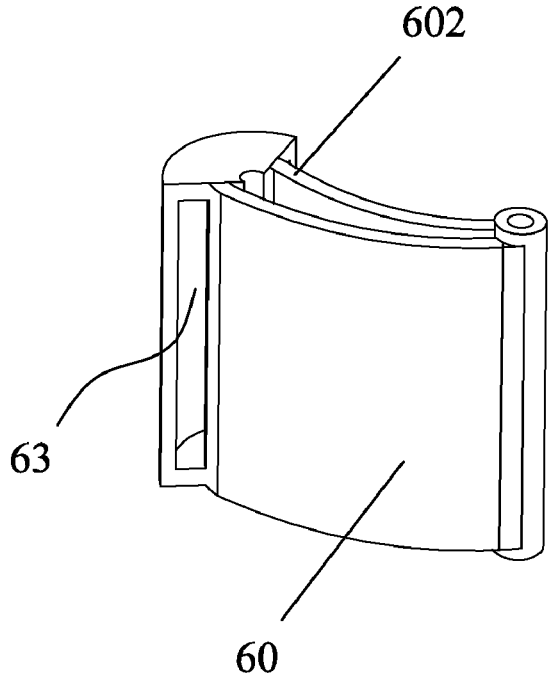
FIG. 10 is an enlarged perspective view showing another swaying member of the present invention.
Figure 11:
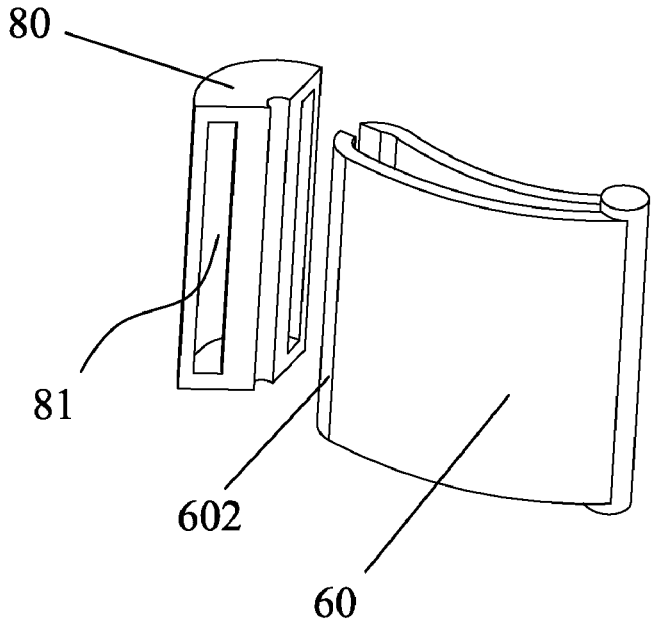
FIG. 11 is an exploded perspective view showing the swaying member adopting a soft limiting member.

Referring to FIGS. 10 and 11, preferably, the second end 602 of the swaying member 60 further installs a limiting structure to limit the moving scope of the communication cable 50.

Referring to FIG. 10, the limiting structure adopts a curve penetrating slot 63 that is integrally formed on the swaying member 60 for the communication cable 50 to pass through. Thereby, the limiting structure would force the communication cable 50 to steadily stay close to the second end 602 of the swaying member 60. Therefore, the communication cable 50 would not be loosened to affect the regular reeling.

Referring to FIG. 11, the limiting structure adopts a soft limiting member 80, which is made of PVC or rubber, mounted on the second end of the swaying member 60. Wherein, the soft limiting member 80 further provides with a curve penetrating slot 81 for the communication cable 50 to pass through. Preferably, the soft limiting member 80 not only forces the communication cable 50 to stay close to the second end 602 of the swaying member 60 but also provides with a shock absorption efficiency to protect the communication cable 50.

To sum up, the present invention takes advantages of the swaying member 60 that is outwardly movable installed on the spool disk 30 to replace the conventional fastening structure provided by the immovable clip applied to the communication cable. By means of the movement of the swaying member 60, the bent angle 501 at the second end 602 of communication cable 50 would be widened, so that the communication cable 50 is needless to be bent that sharp. Therefore, the communication cable preferably avoids the damage and gets favorably protected; the core contained therein is especially protected. Moreover, the arrest of the spool disk 30 is accomplished via the cooperation of the movable engaging member 40 and the circularly and densely spread limiting notches 31. Thus, the structure of the product could be more compact, and the brake performance of the spool disk 30 could be greatly improved, which results in a more precise control of the communication cable 50's stretching length and conduces to the using convenience.

While we have shown and described the embodiment in accordance with the present invention, it should be clear to those skilled in the art that further embodiments may be made without departing from the scope of the present invention.

I claim:

1. A retractable cable device having protecting function comprising a housing, a spiral spring, a spool disk, an arresting system, and a communication cable; wherein, said spool disk being pivotally mounted on a shaft inside said housing, and said communication cable being wound around said spool disk; one end of said spiral spring being coupled to said spool disk, and other end thereof being coupled to said shaft, so said spool disk being provided with a reeling force to reel in said communication cable; a rotation of said spool disk being flexibly controlled by said arresting system to decide a protruding length of said communication cable; characterized in that said spool disk further including a swaying member installed thereon, and said housing further having a limiting ring installed thereon to limit an outward swaying scope of said swaying member; wherein, a first end of said swaying member being vertically and pivotally coupled to said spool disk, thereby forming a fixed interval between said first end and an outer wall of said spool disk; a second end of said swaying member being directed to a movable portion; said communication cable passing through said fixed interval to be reversely bent at said second end so as to wind on said swaying member.

2. The retractable cable device as claimed in claim 1, wherein, said swaying member includes an inner portion and an outer portion integrally formed thereon, and said inner portion and said outer portion are connected at said second end by a smooth arc.

3. The retractable cable device as claimed in claim 1, wherein, said arresting system includes a movable engaging member and a plurality of limiting notches defined on said spool disk; wherein, said limiting notches are defined on an upper end of said spool disk as well as evenly and compactly spread around said shaft, and each of said limiting notches has its respective inward and upward cavity; a locating ring is further disposed on a center of said upper end of said spool disk;

said movable engaging member includes an operating portion, an annular portion, an engaging portion, and a relocating portion integrally formed thereon; wherein, said shaft is surrounded by said annular portion so as to define a lateral interval therebetween; said operating portion and said engaging portion are respectively and integrally connected to two opposite sides of said annular portion;

said operating portion is upwardly protruded out of said housing, a middle portion of said operating portion is inserted in a transverse notch of said housing, a hook is downwardly extended from an extended tail of said engaging portion, and said hook is downwardly stretched into said limiting notch; said relocating portion is integrally, slantingly, and downwardly extended from a lower surface of said engaging portion, and said extended tail is elastically propped on said external portion of said locating ring.

4. The retractable cable device as claimed in claim 1, wherein, said upper end and a lower end of said outer wall of said spool disk respectively and integrally provide with an ear for said first end of said swaying member to be pivoted therebetween.

5. The retractable cable device as claimed in claim 1, wherein, said second end of said swaying member further installs a limiting structure to limit moving scope of said communication cable.

6. The retractable cable device as claimed in claim 5, wherein, said limiting structure adopts a curve penetrating slot that is integrally formed on said swaying member for said communication cable to pass through.

7. The retractable cable device as claimed in claim 5, wherein, said limiting structure adopts a soft limiting member mounted on said second end of said swaying member, and said soft limiting member further provides with a curve penetrating slot for said communication cable to pass through.

* * * * *